US007234550B2

(12) United States Patent
Azar et al.

(10) Patent No.: US 7,234,550 B2
(45) Date of Patent: Jun. 26, 2007

(54) BITS AND CUTTING STRUCTURES

(75) Inventors: Michael George Azar, The Woodlands, TX (US); Jonathan Craig Thiele, Katy, TX (US); Tommy Gene Ray, Houston, TX (US); Gary Chunn, Conroe, TX (US)

(73) Assignee: Smith International, Inc., Houston, TX (US)

( * ) Notice: Subject to any disclaimer, the term of this patent is extended or adjusted under 35 U.S.C. 154(b) by 173 days.

(21) Appl. No.: 10/696,535

(22) Filed: Oct. 29, 2003

(65) Prior Publication Data

US 2004/0159471 A1 Aug. 19, 2004

Related U.S. Application Data

(60) Provisional application No. 60/446,967, filed on Feb. 12, 2003.

(51) Int. Cl.
*E21B 10/573* (2006.01)

(52) U.S. Cl. ..... 175/432; 175/434

(58) Field of Classification Search ..... 175/434, 175/425, 426, 432

See application file for complete search history.

(56) References Cited

U.S. PATENT DOCUMENTS

| | | | | |
|---|---|---|---|---|
| 3,318,399 | A * | 5/1967 | Garner | 175/434 |
| 4,699,227 | A * | 10/1987 | Wardley | 175/433 |
| 4,718,505 | A * | 1/1988 | Fuller | 175/428 |
| 4,919,220 | A * | 4/1990 | Fuller et al. | 175/433 |
| 4,943,488 | A * | 7/1990 | Sung et al. | 428/552 |
| 5,045,092 | A * | 9/1991 | Keshavan | 51/293 |
| 5,159,857 | A | 11/1992 | Jurewicz | |
| 5,217,081 | A * | 6/1993 | Waldenstrom et al. | 175/420.2 |
| 5,279,374 | A * | 1/1994 | Sievers et al. | 175/374 |
| 5,351,770 | A * | 10/1994 | Cawthorne et al. | 175/374 |
| 6,193,000 | B1 * | 2/2001 | Caraway et al. | 175/431 |
| 6,315,066 | B1 * | 11/2001 | Dennis | 175/431 |
| 2001/0047891 | A1 * | 12/2001 | Traux et al. | 175/426 |
| 2002/0125048 | A1 | 9/2002 | Traux et al. | |

FOREIGN PATENT DOCUMENTS

| | | |
|---|---|---|
| GB | 2 198 169 | 6/1988 |
| GB | 2 324 553 | 10/1998 |

OTHER PUBLICATIONS

Great Britian Application No. GB0403176.1 Combined Search and Examination Report dated Apr. 27, 2004 (6 pages).
Office Action issued in corresponding Canadian Pat. application No. 2,457,369 dated Mar. 6, 2006 (3 pages).

* cited by examiner

*Primary Examiner*—Hoang Dang
(74) *Attorney, Agent, or Firm*—Osha Liang LLP

(57) ABSTRACT

An insert for a drill bit which includes a diamond impregnated body, and a shearing portion disposed on said body is shown. In addition, a method for forming a drill bit that includes (a) forming a shearing portion on a diamond-impregnated insert body to form a cutting insert, (b) forming a bit body having a plurality of sockets sized to receive a plurality of the cutting inserts, and (c) mounting the plurality of cutting inserts in the bit body and affixing the plurality of cutting inserts to the bit body; wherein steps (a)–(c) are carried out such that a total exposure of the diamond-impregnated insert to temperatures above 1000° F. is greater than a total exposure of the shearing portion to temperatures above 1000° F.

33 Claims, 7 Drawing Sheets

BITS AND CUTTING STRUCTURES

CROSS-REFERENCE TO RELATED APPLICATIONS

This invention claims priority from U.S. provisional application Ser. No. 60/446,967 filed on Feb. 12, 2003. That application is hereby incorporated by reference in its entirety.

STATEMENT REGARDING FEDERALLY SPONSORED RESEARCH OR DEVELOPMENT

Not applicable.

BACKGROUND OF INVENTION

1. Field of the Invention

The present invention relates generally to drill bits used in the oil and gas industry and more particularly, to drill bits having diamond-impregnated cutting surfaces. Still more particularly, the present invention relates to drag bits in which the diamond particles imbedded in the cutting surface have not suffered the deleterious thermal exposure that is normally associated with the manufacture of such bits.

2. Background Art

Rotary drill bits with no moving elements on them are typically referred to as "drag" bits. Drag bits are often used to drill very hard or abrasive formations.

Drag bits include those having cutting elements attached to the bit body, such as polycrystalline diamond compact insert bits, and those including abrasive material, such as diamond, impregnated into the surface of the material which forms the bit body. The latter bits are commonly referred to as "impreg" bits.

An example of a prior art diamond impregnated drill bit is shown in FIG. 1. The drill bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Diamond impregnated drill bits are particularly well suited for drilling very hard and abrasive formations. The presence of abrasive particles both at and below the surface of the matrix body material ensures that the bit will substantially maintain its ability to drill a hole even after the surface particles are worn down.

Different types of bits work more efficiently with different formations. For example, bits containing inserts that are designed to shear the formation frequently drill formations that range from soft to medium hard with some abrasiveness. These inserts often have polycrystalline diamond compacts (PDC's) as their cutting faces. For "hard" and highly abrasive formations, the mechanism for drilling changes from shearing to abrasion. For abrasive drilling, diamond impregnated inserts are effective.

During abrasive drilling with a diamond-impregnated cutting structure, the diamond particles scour or abrade away the rock. As the matrix material around the diamond granules crystals is worn away, the diamonds at the surface eventually fall out and other diamond particles are exposed.

Impreg bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In a typical impreg bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. It has been found, however, that the life of both natural and synthetic diamond is shortened by the lifetime thermal exposure experienced in the furnace during the infiltration process. Accordingly, it is desired to provide a technique for manufacturing bits that include imbedded diamonds that have not suffered the thermal exposure normally associated with the manufacture of such bits. Furthermore, it is desirable to provide a bit that includes diamond particles in its primary or leading cutting structures without subjecting the diamond particles to undue thermal stress or thermal exposure. Such a bit structure is disclosed in U.S. Pat. No. 6,394,202 (the '202 patent), which is assigned to the assignee of the present invention and is hereby incorporated by reference.

Referring now to FIG. 2, a drill bit 20 in accordance with the '202 patent comprises a shank 24 and a crown 26. Shank 24 is typically formed of steel or a matrix material and includes a threaded pin 28 for attachment to a drill string. Crown 26 has a cutting face 22 and outer side surface 30. According to one embodiment, crown 26 is formed by infiltrating a mass of tungsten-carbide powder impregnated with synthetic or natural diamond, as described above.

Crown 26 may include various surface features, such as raised ridges 27. Preferably, formers are included during the manufacturing process, so that the infiltrated, diamond-impregnated crown includes a plurality of holes or sockets 29 that are sized and shaped to receive a corresponding plurality of diamond-impregnated inserts 10. Once crown 26 is formed, inserts 10 are mounted in the sockets 29 and affixed by any suitable method, such as brazing, adhesive, mechanical means such as interference fit, or the like. As shown in FIG. 3, the sockets can each be substantially perpendicular to the surface of the crown. Alternatively, and as shown in FIG. 3, holes 29 can be inclined with respect to the surface of the crown 26. In this embodiment, the sockets are inclined such that inserts 10 are oriented substantially in the direction of rotation of the bit, so as to enhance cutting.

As a result of the manufacturing technique of the '202 patent, each diamond-impregnated insert is subjected to a total thermal exposure that is significantly reduced as compared to previously known techniques for manufacturing infiltrated diamond-impregnated bits. For example, diamonds imbedded according to the '202 patent have a total thermal exposure of less than 40 minutes, and more typically less than 20 minutes (and more generally about 5 minutes), above 1500° F. This limited thermal exposure is due to the hot pressing period and the brazing process. This compares very favorably with the total thermal exposure of at least about 45 minutes, and more typically about 60–120 minutes, at temperatures above 1500° F., that occur in conventional manufacturing of furnace-infiltrated, diamond-impregnated bits. If diamond-impregnated inserts are affixed to the bit body by adhesive or by mechanical means such as interference fit, the total thermal exposure of the diamonds is even less.

Another type of bit is disclosed in U.S. Pat. Nos. 4,823,892, 4,889,017, 4,991,670 and 4,718,505, in which diamond-impregnated abrasion elements are positioned behind the cutting elements in a conventional tungsten carbide (WC) matrix bit body. The abrasion elements are not the primary cutting structures during normal bit use.

As noted above, different types of bits are selected based on the primary nature of the formation to be drilled. However, many formations have mixed characteristics (i.e., the formation may include both hard and soft zones), which may reduce the rate of penetration of a bit (or, alternatively, reduces the life of a selected bit) because the selected bit is not preferred for certain zones. One type of "mixed formation" include abrasive sands in a shale matrix. In this type of formation, if a conventional impregnation bit is used, because the diamond table exposure of this type of bit is small, the shale can fill the gap between the exposed diamonds and the surrounding matrix, reducing the cutting effectiveness of the bit (i.e., decreasing the rate of penetration (ROP)). In contrast, if a PDC cutter is used, the PDC cutter will shear the shale, but the abrasive sand will cause rapid cutter failure (i.e., the ROP will be sufficient, but wear characteristics will be poor).

What is needed, therefore, are bits and inserts that are suited to drill various types of formation, that do not suffer significantly increased wear or significantly decreased rate of penetration when contacting various zones.

SUMMARY OF INVENTION

In one aspect, the present invention relates to an insert for a drill bit which includes a diamond-impregnated body, and a shearing portion disposed on said body.

In another aspect, the present invention relates to a method for forming a drill bit that includes (a) forming a shearing portion on a diamond-impregnated insert body to form a cutting insert, (b) forming a bit body having a plurality of sockets sized to receive a plurality of the cutting inserts, and (c) mounting the plurality of cutting inserts in the bit body and affixing the plurality of cutting inserts to the bit body; wherein steps (a)–(c) are carried out such that a total exposure of the diamond-impregnated insert to temperatures above 1000° F. is greater than a total exposure of the shearing portion to temperatures above 1000° F.

In another aspect, the present invention relates to a drill bit that includes a bit body having at least one blade thereon, and at least one cutting element disposed on the at least one blade, wherein the at least one cutting element comprises a diamond impregnated body, and a shearing portion disposed on said body.

Other aspects and advantages of the invention will be apparent from the following description and the appended claims.

DETAILED DESCRIPTION

In one aspect, the present invention relates to diamond-impregnated inserts that have specialized compositions. In particular, the present invention relates to inserts that provide a combination of shearing and grinding action from a single element. Accordingly, in a preferred embodiment, the present invention includes the combination of a diamond-impregnated insert with a second, shearing, "miniature" element.

According to a preferred embodiment, diamond-impregnated inserts that will comprise the cutting structure of a bit are formed separately from the bit. Because the inserts are smaller than a bit body, they can be hot pressed or sintered for a much shorter time than is required to infiltrate a bit body. The inserts may be "brazed" into sockets in order to prevent diamond degradation.

Figure 6A:
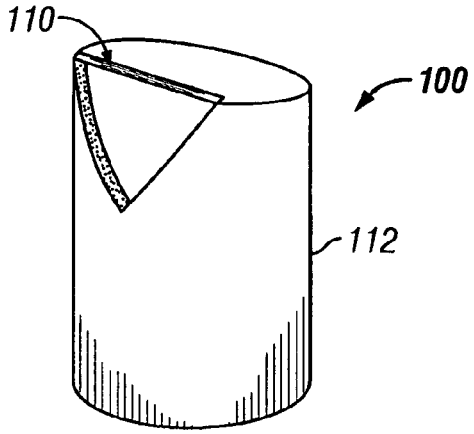
FIGS. 6*a*–6*b* show inserts made in accordance with embodiments of the present invention.

In a preferred embodiment of the invention, the inserts 100 are manufactured as individual components, as shown for example in FIG. 6*a*. According to one preferred embodiment, diamond particles and powdered matrix material are placed in a mold. The contents are then hot-pressed or sintered at an appropriate temperature, preferably between about 1000 and 2200° F., more preferably below 1800° F., to form a composite insert. Heating of the material can be by furnace or by electric induction heating, such that the heating and cooling rates are rapid and controlled in order to prevent damage to the diamonds.

If desired, a very long cylinder having the outside diameter of the ultimate insert shape can be formed by this process and then cut into lengths to produce diamond-impregnated inserts 100 having the desired length. The dimensions and shape of the diamond-impregnated inserts 100 and of their positioning on the bit can be varied, depending on the nature of the formation to be drilled.

The diamond particles can be either natural or synthetic diamond, or a combination of both. The matrix in which the diamonds are embedded to form the diamond impregnated inserts 100 must satisfy several requirements. The matrix must have sufficient hardness so that the diamonds exposed at the cutting face are not pushed into the matrix material under the very high pressures encountered in drilling. In addition, the matrix must have sufficient abrasion resistance so that the diamond particles are not prematurely released. Lastly, the heating and cooling time during sintering or hot-pressing, as well as the maximum temperature of the thermal cycle, must be sufficiently low that the diamonds imbedded therein are not thermally damaged during sintering or hot-pressing.

To satisfy these requirements, as an exemplary list, the following materials may be used for the matrix in which the diamonds are embedded: tungsten carbide (WC), tungsten alloys such as tungsten/cobalt alloys (W—Co), and tungsten carbide or tungsten/cobalt alloys in combination with elemental tungsten (all with an appropriate binder phase to facilitate bonding of particles and diamonds) and the like. Those of ordinary skill in the art will recognize that other materials may be used for the matrix, including titanium-based compounds, nitrides (in particular cubic boron nitride), etc.

In the present invention, at least about 15%, more preferably about 30%, and still more preferably about 40% of the diamond volume in the entire cutting structure is present in the inserts, with the balance of the diamond being present in the bit body. However, because the diamonds in the inserts have 2–3 times the rock cutting life of the diamonds in the bit body, in a preferred embodiment the inserts provide about 57% to about 67% of the available wear life of the cutting structure. It will further be understood that the concentration of diamond in the inserts can vary from the concentration of diamond in the bit body. According to a preferred embodiment, the concentrations of diamond in the inserts and in the bit body are in the range of 50 to 100 (100=4.4 carat/$cc^3$).

It will be understood that the materials commonly used for construction of bit bodies can be used in the present invention. Hence, in the preferred embodiment, the bit body may itself be diamond-impregnated. In an alternative embodiment, the bit body comprises infiltrated tungsten carbide matrix that does not include diamond.

In an alternative embodiment, the bit body can be made of steel, according to techniques that are known in the art. Again, the final bit body includes a plurality of holes having a desired orientation, which are sized to receive and support inserts 100. Inserts 100 may be affixed to the steel body by brazing, mechanical means, adhesive or the like. The bit can optionally be provided with a layer of hardfacing. In another embodiment, the diamond-impregnated inserts may comprise large, coated (discussed below) natural diamonds. For example, in certain embodiments, diamonds as large as one carat per stone may be used.

In another embodiment, one or more of the diamond-impregnated inserts include imbedded thermally stable polycrystalline diamond (also known as TSP), so as to enhance shearing of the formation. The TSP can take any desired form, and is preferably formed into the insert during the insert manufacturing process.

The manufacture of TSP is known in the art, but a brief description of the process is provided herein. When formed, diamond tables comprise individual diamond "crystals" that are interconnected. The individual diamond crystals thus form a lattice structure. Cobalt particles are often found within the interstitial spaces in the diamond lattice structure. Cobalt has a significantly different coefficient of thermal expansion as compared to diamond, so upon heating of the diamond table, the cobalt will expand, causing cracks to form in the lattice structure, resulting in deterioration of the diamond table.

In order to obviate this problem, strong acids are used to "leach" the cobalt from the diamond lattice structure. Removing the cobalt causes the diamond table to become more heat resistant, but also causes the diamond table to be more brittle. Accordingly, in certain cases, only a select portion (measured either in depth or width) of a diamond table is leached, in order to gain thermal stability without losing impact resistance. As used herein, the term TSP includes both of the above (i.e., partially and completely leached) compounds.

Figure 1:
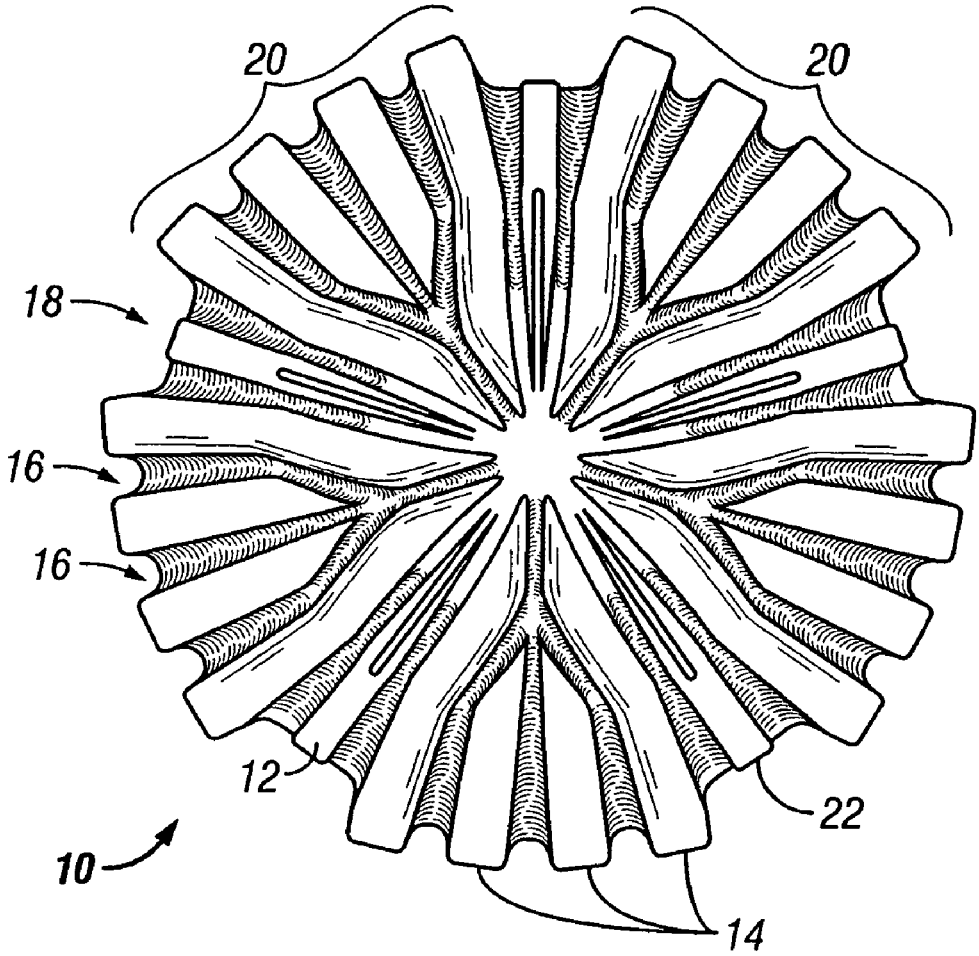
FIG. 1 (PRIOR ART)
FIG. 1 shows a prior art impreg bit.
Figure 2:
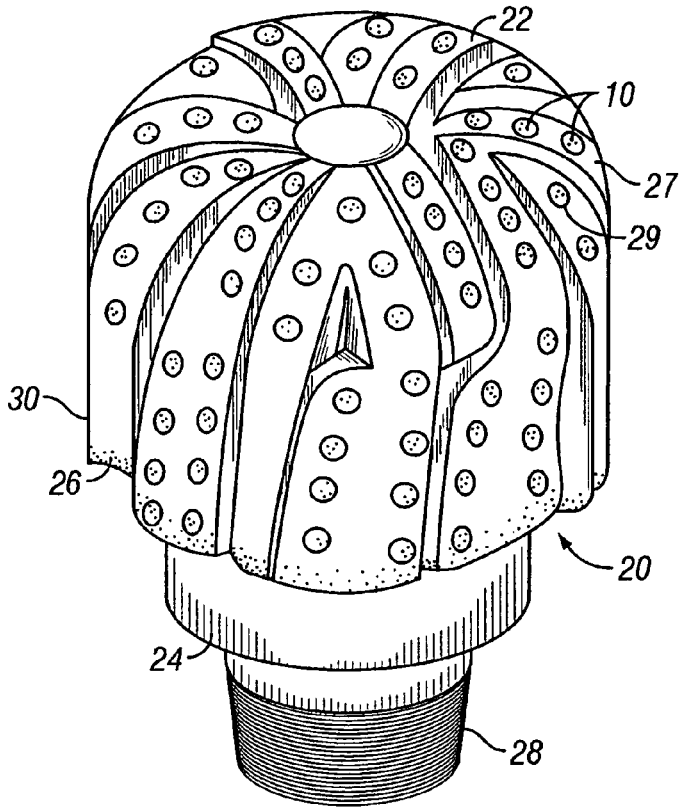
FIG. 2 (PRIOR ART)
FIG. 2 is a perspective view of a second type of impreg bit.
Figure 3:
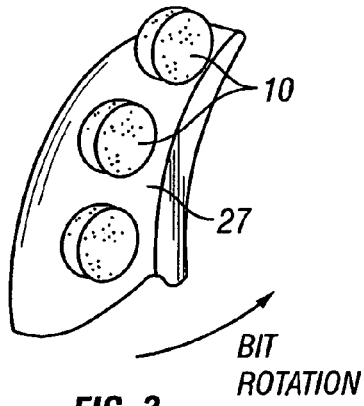
FIG. 3 (PRIOR ART)
FIG. 3 shows rotated inserts.
Figure 4A:
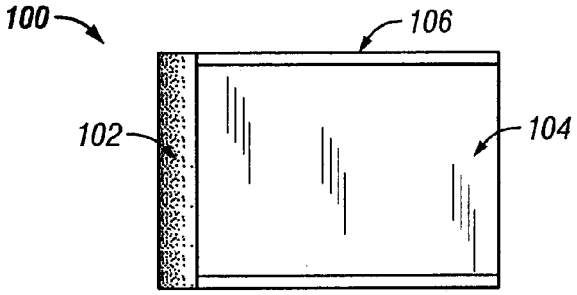
FIGS. 4*a*–4*b* show an insert made in accordance with an embodiment of the present invention.
Figure 4B:
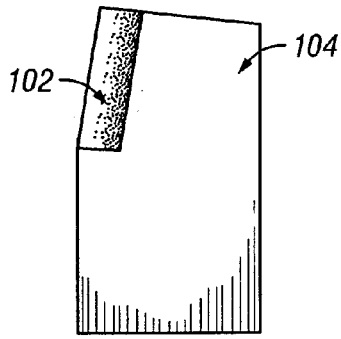

Referring to FIG. 4*a*–4*b*, a novel cutting element in accordance with an embodiment of the present invention is shown. In this embodiment, as seen in FIGS. 4*a* and 4*b*, the insert 100 includes a shearing portion 102 having a given thickness. In a particular embodiment, the shearing portion 102 comprises a diamond table having a selected thickness, which is formed in a manner similar to conventional PDC diamond tables with tungsten carbide substrate. In the embodiment shown, the shearing portion 102 has a thickness of about 0.080 inches to about 0.120 inches. The thickness and nature of this leading edge may be varied, depending on a user's requirements. p In particular, the shearing portion 102 may be formed from a number of compounds, such as cubic boron nitride (CBN), PDC, or TSP. The specific composition of the shearing portion 102 is not critical, but may be selected to provide the desired shearing action.

Returning to FIGS. 4*a* and 4*b*, the remainder of the insert 100 comprises a body 104, which may be formed in the manner described above. In a preferred embodiment, the body 104 is an impregnated substrate comprising tungsten carbide impregnated with diamond. In an alternative embodiment, the body 104 may comprise tungsten carbide impregnated with TSP or CBN.

Furthermore, in certain embodiments, the insert 100 is provided with an outer layer 106, which provides a brazing surface. In a preferred embodiment, the outer layer 106 comprises a thin "virgin" (i.e., not impregnated) tungsten carbide layer, in order to promote effective brazing (i.e., maintain the braze strength) of the insert 100 into a socket (not shown) on a drill bit (not shown).

By brazing the insert 100 into a socket, which occurs at significantly lower temperature than diamond impregnation, thermal degradation of the shearing portion 102 may be avoided. Advantageously, therefore, the integrity of the shearing portion is maintained. During drilling, the leading edge of shearing portion 102 provides shearing cutting action similar to that of a PDC cutter. As wear progresses, the body 104 of the insert 100 introduces impregnated diamonds to the formation, increasing drilling efficiency and limiting the progression of wear. Thus, an insert formed in this manner includes both a shearing portion (102) and an abrasive portion (104).

Figure 5:
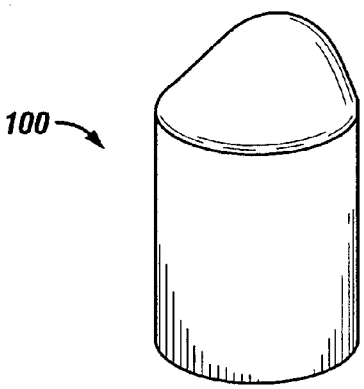
FIG. 5 shows an alternative shape for an insert formed in accordance with embodiments of the present invention.

While FIGS. 4*a* and 4*b* illustrate an insert 100 having a "post" shape, no limitation on the present invention is intended by the shown geometry. For example, FIG. 5 shows an insert 100 having a "saddle" shaped top portion.

Figure 6B:
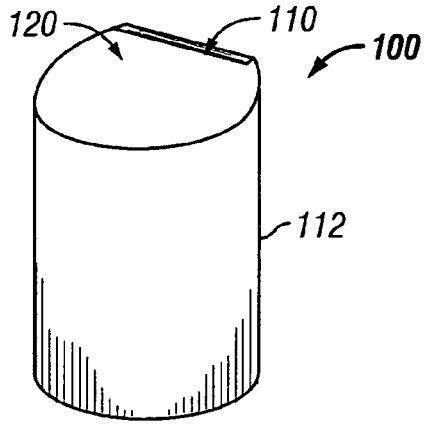

FIGS. 6*a* and 6*b* show alternative embodiments of the present invention. In FIG. 6*a*, an insert 100 having a shearing portion 110 and an abrasive portion 112 is shown. In this embodiment, the shearing portion 110 has a "V" shape. Again, other geometries for the shearing portion are possible and are expressly within the scope of the present invention. In FIG. 6*a*, the shearing portion 110 comprises CBN deposited on a diamond-impregnated substrate (the abrasive portion 112).

In FIG. 6*b*, a bonding portion 120 is disposed between the shearing portion 110 and the abrasive portion 112. In one embodiment, the shearing portion 110 comprises CBN, the abrasive portion 112 comprises diamond-impregnated tungsten carbide, and the bonding portion 120 comprises "virgin" (i.e., non-impregnated) tungsten carbide. The bonding portion is provided to increase the bond strength between the shearing and abrasive portion. For certain combinations of the compounds described herein, such as PDC, TSP, CBN, or ceramic materials, the bond between the shearing portion and abrasive portion may be too weak to survive sustained drilling. In this case, a bonding portion may be provided.

Accordingly, in certain embodiments, such as those where there is no tungsten carbide bonding portion, and the shearing portion comprises TSP, the shearing portion may be coated with a material to either create or enhance a bond between the diamond-impregnated body and the shearing portion. Typically, in preferred embodiments, this occurs in one of two ways, which are described with reference to FIGS. 7*a*–7*d* below.

Figure 7A:
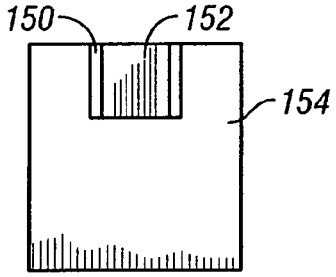
FIGS. 7*a*–7*d* illustrate methods for enhancing a bond between a shearing portion and a substrate in accordance with an embodiment of the present invention.
Figure 7B:
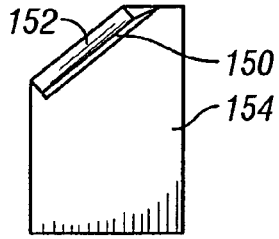

In FIGS. 7*a* and 7*b*, a coating 150 is applied to the shearing portion 152 to strengthen a bond between the shearing portion 152 and the diamond-impregnated body 154. In a preferred embodiment, the coating 150 comprises a layer of virgin tungsten carbide, applied to a TSP shearing portion, to enhance the metallurgical bond between the body 154 and the shearing portion 152. FIG. 7*b* shows the same technique, but shows an insert having a different geometry than that depicted in FIG. 7*a*. In various embodiments, the coating may comprise a titanium based coatings, tungsten based coatings, nickel coatings, various carbides, nitrides, and other materials known to those skilled in the art.

Figure 7C:
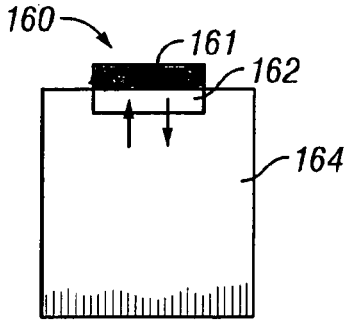
Figure 7D:
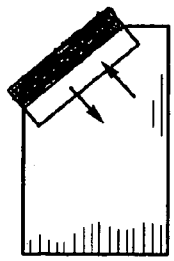

FIGS. 7*c* and 7*d*, in contrast, illustrate a case in which a shearing portion having a substrate is used. In FIG. 7*c*, a shearing portion 160 includes a cap 161 and a substrate 162. In a preferred embodiment, the shearing portion 160 is a PDC cutter. In a preferred embodiment, the substrate 162 includes a binder metal, such as cobalt, which can migrate into the diamond-impregnated body 164. Accordingly, cobalt from the substrate 162 may migrate into diamond-impregnated body 164, and vice versa, enhancing the bond between the diamond-impregnated body 164 and the substrate 162.

Further, in certain embodiments, such as those in which the abrasive portion comprises diamond impregnated tungsten carbide, the bonding portion is virgin tungsten carbide, and the shearing portion comprises CBN, the bonding layer wears faster than the abrasive or shearing portions. This has the effect of "sharpening" the shearing portion (which is the leading edge of the insert). As the bonding portion wears, new surfaces of the shearing portion are constantly being exposed, which assists in maintaining good shearing action.

The present invention allows bits to be easily constructed having inserts in which the size, shape, and/or concentration of diamond in the cutting structure is controlled in a desired manner. Likewise, the inserts can be created to have different lengths, or mounted in the bit body at different heights or angles, so as to produce a bit having a multiple height cutting structure. This may provide advantages in drilling efficiency. For example, a bit having extended diamond-impregnated inserts as a cutting structure will be able to cut through downhole float equipment that could not be cut by a standard diamond-impregnated bit, thereby eliminating the need to trip out of the hole to change bits.

Additionally, a bit having such extended diamond-impregnated inserts will be able to drill sections of softer formations that cannot be efficiently drilled with conventional diamond-impregnated bits. In contrast, embodiments of the present invention makes efficient drilling of softer formations possible due to shearing action of inserts that extend beyond the surface of the bit body.

Figure 8:
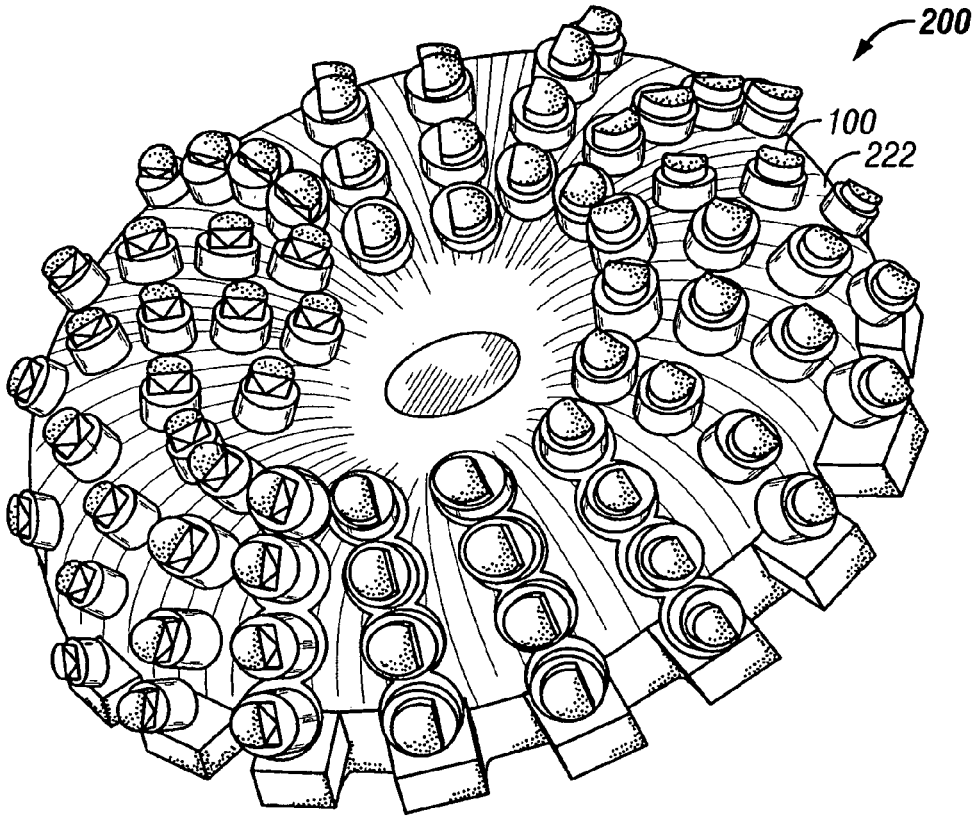
FIG. 8 shows an impreg bit formed in accordance with one embodiment of the present invention.

Referring now to FIG. 8, a drill bit head 200 according to one embodiment of the present invention is shown. According to one preferred embodiment, the drill bit head 200 is formed by infiltrating a mass of tungsten-carbide powder impregnated with synthetic or natural diamond, as described above. Preferably, formers are included during the manufacturing process, so that the infiltrated, diamond-impregnated drill bit head 200 includes a plurality of holes or sockets 222 that are sized and shaped to receive a corresponding plurality of diamond-impregnated inserts 100. Once the sockets 222 are formed, inserts 100 are mounted in the sockets and affixed by any suitable method, such as brazing, adhesive, mechanical means such as interference fit, or the like.

Figure 9:
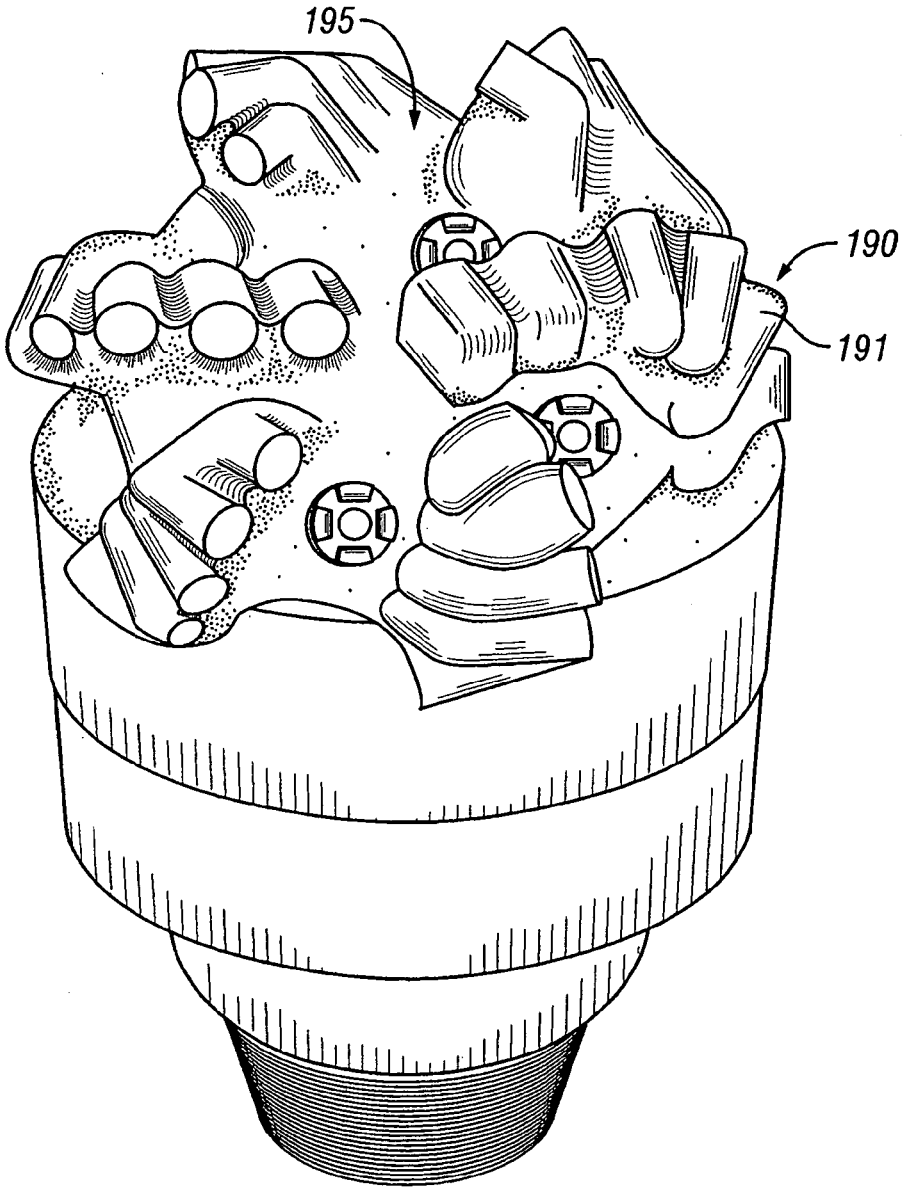
FIG. 9 shows a PDC bit, which includes inserts formed in accordance with one embodiment of the present invention.

While reference has been made to impreg bits, inserts formed in accordance with the present invention may also be adapted to be used in "conventional" PDC cutting structures. In particular, inserts in accordance with the present invention may replace some or all of the polycrystalline diamond inserts used in PDC bits. FIG. 9 illustrates one such embodiment.

In FIG. 9, a drill bit 190 having at least insert 100 in place of a PDC cutter is depicted. As shown in FIG. 8, the drill bit 190 is formed with at least one blade 191, which extends generally outwardly away from a central longitudinal axis 195 of the drill bit 190. The at least insert 100 is disposed on the at least one blade 191. The number of blades 191 and/or inserts 100 is related to the type of rock to be drilled, and can thus be varied to meet particular rock drilling requirements.

The at least one insert 100 in the present example comprises an impregnated diamond base and a shearing portion mounted thereon. The at least one blade 191 has at least one socket or mounting pad (not numbered separately), which is adapted to receive the at least one insert 100. In the present embodiment, the at least one insert 100 is brazed onto the at least one socket. Accordingly, in a preferred embodiment, the at least one insert 100 may be provided with an outer layer of virgin tungsten carbide to improve braze strength.

It should be noted that references to the use of specific substrate compositions are for illustrative purposes only, and no limitation on the type of substrate used is intended. As an example, it is well known that various metal carbide compositions, in addition to tungsten carbide, may be used.

Further, embodiments of the present invention may include non-planar geometry to form a non-planar interface between the abrasive portion and shearing portion to reduce the inherent stresses present at the interface. The use of non-planar interfaces is known in the art. For example, U.S. Pat. No. 5,494,477 discloses one such non-planar interface and is hereby incorporated by reference.

A second system using a non-planar interface is disclosed in U.S. Pat. No. 5,662,720. In this system, the surface topography of the substrate system is altered to create an "egg-carton" appearance. The use of an "egg-carton" shape allows the stress associated with the cutting to be distributed over a larger surface area, thereby reducing the probability of delamination of the shearing portion from the substrate.

Figure 10:
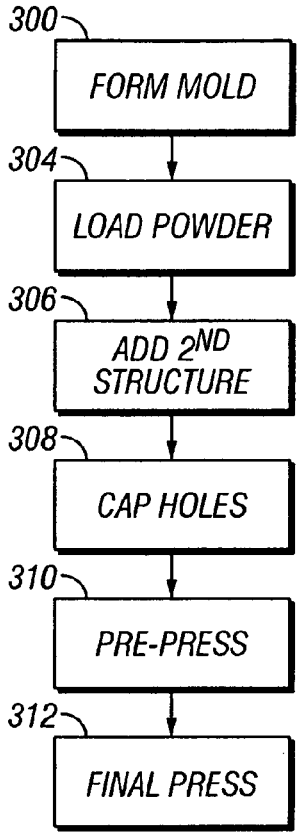
FIG. 10 shows a flow chart illustrating one method of forming an insert in accordance with the present invention.

One suitable method of forming an insert in accordance with the present invention is now described, with reference to FIG. 10. First, a mold, which defines dimensions of an insert, is formed (300). The mold may be made of any suitable material known in the art, such as graphite. In one embodiment, the mold comprises a block having one or more holes and at least an upper and a lower plunger for each hole (not shown). Alternatively, a series of upper and lower plungers may be used. The upper and lower plunger are used to define the height of the insert. Alternatively, the hole may have a fixed bottom and only an upper plunger is required for defining the height of the insert. After forming the mold, powder of a suitable material, as noted above, that forms the diamond-impregnated body of the insert upon heating and pressure is loaded into the holes, with the lower plungers in place (304). Then, the upper plunger is placed into the hole, "capping" the hole shut (308). In a preferred embodiment, the mold assembly is then pre-pressed in a hand operated press (310). Finally, the mold assembly is placed in the hot press furnace (312) for the production of a diamond-impregnated insert body. In one embodiment, a second cutting structure (e.g., the shearing portion) is added after the formation of the diamond-impregnated insert body.

In a preferred embodiment, however, the second cutting structure is placed into the hole (306) on top of the powder material that is to form the diamond-impregnated insert body, before or at the time the upper plunger is placed into the hole to cap this hole (308). No specific geometry of cutting structure is required by this invention. With this embodiment, the bonding between the diamond-impregnated insert body and the second cutting structure (the shearing portion) is formed during hot press.

In a preferred embodiment, the second cutting structure is physically attached to a surface of the upper plunger, prior the placing the upper plunger in the hole. Because the upper plunger is designed and manufactured based on the shape of the diamond-impregnated body and second cutting structure, the second cutting structure "mates" with the upper plunger. Accordingly, the orientation and position of the second cutting element may be set at this stage. Additionally, the surface of the upper plunger to which the second cutting structure is attached may be "scribed" or marked to aid in proper positioning of the second cutting element. The upper plunger/second cutting element may then be placed into the hole, "capping" the hole shut (308). In a preferred embodiment, the mold assembly is then pre-pressed in a hand operated press (310). Finally, the mold assembly is then placed in the hot press furnace (312) for the production of an insert having a diamond-impregnated body with a shearing portion disposed thereon.

Accordingly, based on this method, diamond-impregnated inserts having a specified geometry may be formed. Further, based on this method, a shearing portion having a specified geometry may be used in conjunction with the diamond-impregnated insert. The resulting insert, therefore, can have a specific geometry, which is adapted to more effectively drill a formation.

Alternate methods of forming an insert may be used. For example, a high pressure, high temperature (HPHT) process for sintering diamond or cubic boron nitride may be used. Such a process has been described in U.S. Pat. No. 5,676,496 and No. 5,598,621 and their teachings are incorporated by reference herein. Another suitable method for hot-compacting pre-pressed diamond/metal powder mixtures is hot isostatic pressing, which is known in the art. See Peter E. Price and Steven P. Kohler, "Hot Isostatic Pressing of Metal Powders", *Metals Handbook*, Vol. 7, pp. 419–443 (9th ed. 1984). As noted above, the HPHT process can be done with both the powder and the shearing portion present, or the diamond-impregnated body can be formed prior to attachment of a shearing portion.

Figure 11A:
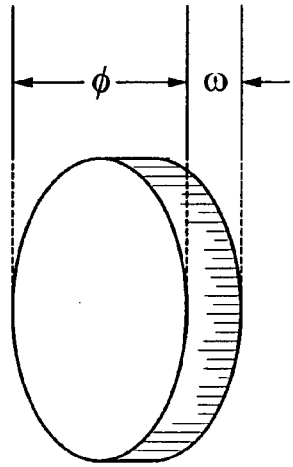
FIGS. 11*a* and 11*b* show exemplary shearing portions for use in inserts in accordance with the present invention.
Figure 11B:
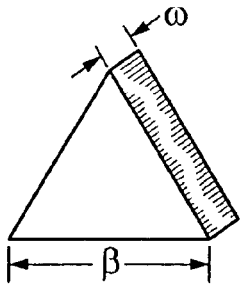

FIGS. 11*a* and 11*b* show particular shearing portions for use in embodiments of the present invention. FIG. 11*a* shows a circular PDC cutter that may be used as a shearing portion in accordance with embodiments of the present invention. In FIG. 11*a*, the PDC cutter having a diameter $\phi$ (which, in certain embodiments, ranges from 6–9 mm) and a thickness $\omega$ (which, in certain embodiments, ranges from 2–4 mm). In FIG. 11*b*, a triangular CBN shearing portion is shown. In FIG. 11*b*, the CBN shearing portion is shown having a length B (which, in certain embodiments, is 6–9 mm) and a thickness $\omega$ (which, in certain embodiments, ranges from 2–4 mm).

Figure 12:
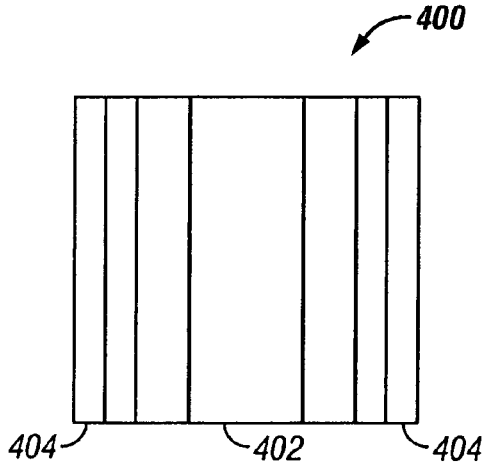
FIG. 12 shows an insert in accordance with one embodiment of the present invention.

FIG. 12 illustrates another aspect of the present invention. In FIG. 12, an insert 400 is shown having a varying composition from a center portion 402 to an exterior portion 404. By varying the composition (such as the diamond content) of the insert 400, the relative hardness of the insert can be tailored to a given formation. Also, wear characteristics may be better controlled by such control. The composition may vary in either a uniform or non-uniform manner. In particular, while FIG. 12 illustrates the insert 400 having similar compositions on either side of the center portion 402 (i.e., exterior portion 404 has the same composition) this is not necessarily required. Depending on the requirements of the user, the composition may be altered around the location where the shearing portion is to be placed.

Further, while embodiments of the present invention have disclosed various matrix materials, it should be noted that other suitable materials will be apparent to those of ordinary skill in the art. In particular, the matrix material may be a CBN composite, rather than a tungsten carbide composite. CBN composites have the advantage of being more thermally stable than tungsten carbides. In addition, materials may be selected in order to improve certain manufacturing processes. For example, by judiciously selecting compositions, frictional heat generation during abrasion of the composite may be reduced. This can be achieved by selecting matrix material with abrasion resistance lower than diamond and with lower friction coefficient. For example, CBN instead of WC may be used in the matrix with ceramic binder.

Further, mixtures of any of the materials disclosed herein, or those known to one of ordinary skill in the art may be used. For example, it is expressly within the scope of the present invention that an insert body may be formed that comprises diamond, CBN, TiC (or TiN), cobalt aluminide pressed using the HPHT or other processes described above.

While reference to particular diameters, lengths, and thicknesses are discussed, no limitation on the scope of the present invention is intended thereby. In particular, the size of the insert, and the shearing portion will vary depending on the nature of the formation to be drilled and/or other criteria selected by the user.

Further, other structures known in the art may be used in conjunction with the shearing portion disposed on a diamond-impregnated body disclosed above. For example, in certain embodiments, a "wear" portion may be present on the insert. Specifically, a wear portion may comprise a bearing surface used in gauge pads.

Advantageously, embodiments of the present invention provide cutting elements that can "grind" a formation as well as "shear" a formation, to increase the overall rate of penetration and/or wear resistance of a bit. Furthermore, advantageously, embodiments of the present invention provide better drilling results when drilling mixed formations (i.e., formations having both hard and soft characteristics such as sand/shale formations).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An insert for a drill bit comprising:

a diamond-impregnated insert body; and a thermally stable shearing portion disposed on said diamond-impregnated insert body, wherein the thermally stable shearing portion comprises thermally stable polycrystalline diamond, and wherein at least a portion of the diamond-impregnated insert body and at least a portion of the thermally stable shearing portion form a leading edge of the insert, wherein the leading edge corresponds to the rotational direction of a drill bit.

2. The insert of claim 1, further comprising a bonding portion disposed between at least a portion of said diamond-impregnated insert body and said thermally stable shearing portion.

3. The insert of claim 2, wherein said bonding portion comprises tungsten carbide.

4. The insert of claim 1, further comprising an outer layer disposed on said diamond-impregnated insert body.

5. The insert of claim 4, wherein said outer layer comprises a tungsten carbide layer.

6. The insert of claim 1, wherein said diamond-impregnated insert body comprises thermally stable polycrystal line diamond.

7. The insert of claim 1, wherein said thermally stable shearing portion is disposed on said diamond-impregnated insert body post-infiltration.

8. The insert of claim 1, further comprising a wear portion disposed on a surface of said diamond-impregnated insert body.

9. The insert of claim 1, wherein said thermally stable shearing portion further comprises a coating.

10. The insert of claim 9, wherein said coating comprises at least one selected from the group consisting of a titanium based coating, a tungsten based coating, and a nickel based coating.

11. The insert of claim 1, wherein the diamond-impregnated insert body comprises coated natural diamond.

12. The insert of claim 1, wherein at least a portion of the natural diamond is 1 carat in size.

13. A drill bit comprising:

a bit body having at least one blade thereon; and at least one cutting element disposed on the at least one blade, wherein the at least one cutting element comprises a diamond-impregnated insert body;

and a thermally stable shearing portion disposed on said diamond-impregnated insert body, wherein the thermally stable shearing portion comprises thermally stable polycrystalline diamond, and wherein at least a portion of the diamond-impregnated insert body and at least a portion of the thermally stable shearing portion form a leading edge of the insert, wherein the leading edge corresponds to the rotational direction of a drill bit.

14. A drill bit, comprising:

a bit body; and a plurality of inserts affixed to said bit body, at least one of said plurality of inserts having a diamond-impregnated insert body and a thermally stable shearing portion disposed on said diamond-impregnated insert body, wherein the thermally stable shearing portion comprises thermally stable polycrystalline diamond, and wherein at least a portion of the diamond-impregnated insert body and at least a portion of the thermally stable shearing portion form a leading edge of the inserts, wherein the leading edge corresponds to the rotational direction of the drill bit.

15. The bit of claim 14, wherein a total exposure of said diamond-impregnated insert body to temperatures above 1000° F. is greater than a total exposure of said shearing portion to temperatures above 1000° F.

16. The bit of claim 14, wherein at least a portion of said bit body is diamond-impregnated.

17. The bit of claim 14, wherein the bit body comprises infiltrated diamond-impregnated tungsten carbide matrix.

18. The insert of claim 14, wherein said diamond-impregnated insert body comprises thermally stable polycrystalline diamond.

19. The bit of claim 14, further comprising a bonding portion disposed between at least a portion of said diamond-impregnated insert body and said thermally stable shearing portion.

20. The bit of claim 19, wherein said bonding portion comprises tungsten carbide.

21. The bit of claim 14, further comprising an outer layer disposed on said diamond-impregnated insert body.

22. The bit of claim 21, wherein said outer layer comprises a tungsten carbide layer.

23. The bit of claim 14, further comprising a wear portion disposed on a surface of said diamond-impregnated insert body.

24. The bit of claim 18, wherein said shearing portion further comprises a coating.

25. The bit of claim 24, wherein said coating comprises at least one selected from the group consisting of a titanium based coating, a tungsten based coating, and a nickel based coating.

26. A method of drilling a mixed formation comprising:

contacting a bit with the mixed formation, wherein the bit comprises a bit body; and a plurality of inserts affixed to said bit body, at least one of said inserts having a diamond impregnated insert body and a thermally stable shearing portion disposed on said diamond impregnated insert body, wherein the thermally stable shearing portion comprises thermally stable polycrystalline diamond, and wherein at least a portion of the diamond-impregnated insert body and at least a portion of the thermally stable shearing portion form a leading edge of the insert, wherein the leading edge corresponds to the rotational direction of a drill bit.

27. A composite cutting element for a drill bit comprising:

an abrasive insert body having a mixture of ultra-hard material and a less abrasion resistant matrix material, wherein the ultra-hard material is impregnated in the matrix of the less abrasion resistant material; and a thermally stable shearing element on said insert body, wherein the thermally stable shearing portion comprises thermally stable polycrystalline diamond, and wherein at least a portion of the abrasive insert body and at least a portion of the thermally stable shearing portion form a leading edge of the insert, wherein the leading edge corresponds to the rotational direction of a drill bit.

28. The composite cutting element of claim 27 wherein the relative abrasion resistance of the ultra-hard material and the matrix material vary depending on the formation compressive strength and abrasivity and also on the size of the ultra-hard material.

29. The composite cutting element of claim 27 wherein the ultra-hard materials comprises at least one selected from the group consisting of diamond crystals, cubic boron nitride crystals, polycrystalline diamond or polycrystalline cubic nitride crystals.

30. The composite cutting element of claim 27 wherein the matrix material consists of carbides, nitrides, borides or mixtures thereof.

31. The composite cutting element of claim 27 wherein the ultra hard material is diamond crystals and the matrix material is cubic boron nitride crystals cemented with at least one compound selected from the group consisting of carbides, borides, and nitrides.

32. The composite cutting element of claim 27 wherein a diamond concentration and a diamond particle size in the abrasive insert body and the thermally stable shearing element depends on the abrasivity and compressive strength of the formation being drilled.

33. The composite cutting element of claim 32, wherein the diamond concentration in the abrasive insert body is selectively varied.

* * * * *

UNITED STATES PATENT AND TRADEMARK OFFICE

CERTIFICATE OF CORRECTION

PATENT NO. : 7,234,550 B2
APPLICATION NO. : 10/696535
DATED : June 26, 2007
INVENTOR(S) : Michael George Azar et al.

It is certified that error appears in the above-identified patent and that said Letters Patent is hereby corrected as shown below:

In the Claims:

Column 11, line 37, after the word "stable" the words "polycrystal line" should be --polycrystalline--.

Column 11, line 53, "claim 1" should be --claim 11--.

Column 12, line 12, the word "inserts," should be --insert,--.

Column 12, line 38, "claim 18" should be --claim 14--.

Signed and Sealed this

Eighteenth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,234,550 B2
APPLICATION NO. : 10/696535
DATED : June 26, 2007
INVENTOR(S) : Michael George Azar et al.

It is certified that error appears in the above-identified patent and that said Letters Patent is hereby corrected as shown below:

In the Claims:

Column 11, Claim 6, line 37, after the word "stable" the words "polycrystal line" should be --polycrystalline--.

Column 11, Claim 12, line 53, "claim 1" should be --claim 11--.

Column 12, Claim 14, line 12, the word "inserts," should be --insert,--.

Column 12, Claim 24, line 38, "claim 18" should be --claim 14--.

This certificate supersedes the Certificate of Correction issued September 18, 2007.

Signed and Sealed this

Seventh Day of October, 2008

JON W. DUDAS
*Director of the United States Patent and Trademark Office*